US011339689B2

(12) United States Patent
Otsubo et al.

(10) Patent No.: US 11,339,689 B2
(45) Date of Patent: May 24, 2022

(54) VALVE TIMING ADJUSTMENT DEVICE

(71) Applicant: DENSO CORPORATION, Kariya (JP)

(72) Inventors: Makoto Otsubo, Nisshin (JP); Hiroki Takahashi, Kariya (JP); Kenichi Tomomatsu, Nisshin (JP); Shuhei Yamamoto, Nisshin (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/338,350

(22) Filed: Jun. 3, 2021

(65) Prior Publication Data

US 2021/0285344 A1 Sep. 16, 2021

Related U.S. Application Data

(63) Continuation of application No. PCT/JP2019/049779, filed on Dec. 19, 2019.

(30) Foreign Application Priority Data

Dec. 28, 2018 (JP) ..... JP2018-247625

(51) Int. Cl.
*F01L 1/352* (2006.01)
*F01L 1/344* (2006.01)

(52) U.S. Cl.
CPC ..... *F01L 1/352* (2013.01); *F01L 1/344* (2013.01)

(58) Field of Classification Search
CPC ... F01L 1/352; F01L 1/344; F01L 2001/0476; F01L 2250/02; F01L 2820/032; F16H 1/32; F16H 1/10; F16D 3/04
USPC ..... 123/90.15, 90.17
See application file for complete search history.

(56) References Cited

U.S. PATENT DOCUMENTS

2017/0138228 A1* 5/2017 Miyachi ..... F01L 1/047
2018/0073656 A1* 3/2018 Miyachi ..... F16H 1/32
2019/0292952 A1 9/2019 Miyachi et al.

* cited by examiner

*Primary Examiner* — Patrick Hamo
*Assistant Examiner* — Wesley G Harris
(74) *Attorney, Agent, or Firm* — Nixon & Vanderhye P.C.

(57) ABSTRACT

A bearing portion of a planetary rotatable body for providing bearing support in a thrust direction is defined as a planetary thrust bearing portion. A driving-side rotatable body or a driven-side rotatable body, which is configured to contact the planetary thrust bearing portion in the thrust direction, is defined as a specific rotatable body. A bearing portion of the specific rotatable body for providing bearing support in the thrust direction is defined as a specific thrust bearing portion. In a parallel state where the specific thrust bearing portion and the planetary thrust bearing portion are parallel to each other, the specific thrust bearing portion and the planetary thrust bearing portion contact with each other only on one of an eccentric side and a counter-eccentric side of the planetary rotatable body while the counter-eccentric side is opposite to the eccentric side.

10 Claims, 19 Drawing Sheets

VALVE TIMING ADJUSTMENT DEVICE

CROSS REFERENCE TO RELATED APPLICATIONS

This application is a continuation application of International Patent Application No. PCT/JP2019/049779 filed on Dec. 19, 2019, which designated the U.S. and claims the benefit of priority from Japanese Patent Application No. 2018-247625 filed on Dec. 28, 2018. The entire disclosures of all of the above applications are incorporated herein by reference.

TECHNICAL FIELD

The present disclosure relates to a valve timing adjustment device.

BACKGROUND

A previously proposed valve timing adjustment device includes a planetary gear mechanism which has an internal gear section and a planetary gear section. The valve timing adjustment device adjusts a rotational phase of a driven-side rotatable body relative to a driving-side rotatable body. The planetary gear section is urged against the internal gear section by a resilient member to reduce a noise and an impact force generated when the planetary gear section and the internal gear section collide with each other due to, for example, a change in a cam torque.

SUMMARY

This section provides a general summary of the disclosure, and is not a comprehensive disclosure of its full scope or all of its features.

According to the present disclosure, there is provided a valve timing adjustment device that includes a driving-side rotatable body, a driven-side rotatable body and a planetary rotatable body. A bearing portion of the planetary rotatable body for providing bearing support in a thrust direction is defined as a planetary thrust bearing portion. The driving-side rotatable body or the driven-side rotatable body, which is configured to contact the planetary thrust bearing portion in the thrust direction, is defined as a specific rotatable body. A bearing portion of the specific rotatable body for providing bearing support in the thrust direction is defined as a specific thrust bearing portion. In a parallel state where the specific thrust bearing portion and the planetary thrust bearing portion are parallel to each other, the specific thrust bearing portion and the planetary thrust bearing portion contact with each other only on one of an eccentric side and a counter-eccentric side of the planetary rotatable body while the counter-eccentric side is opposite to the eccentric side.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
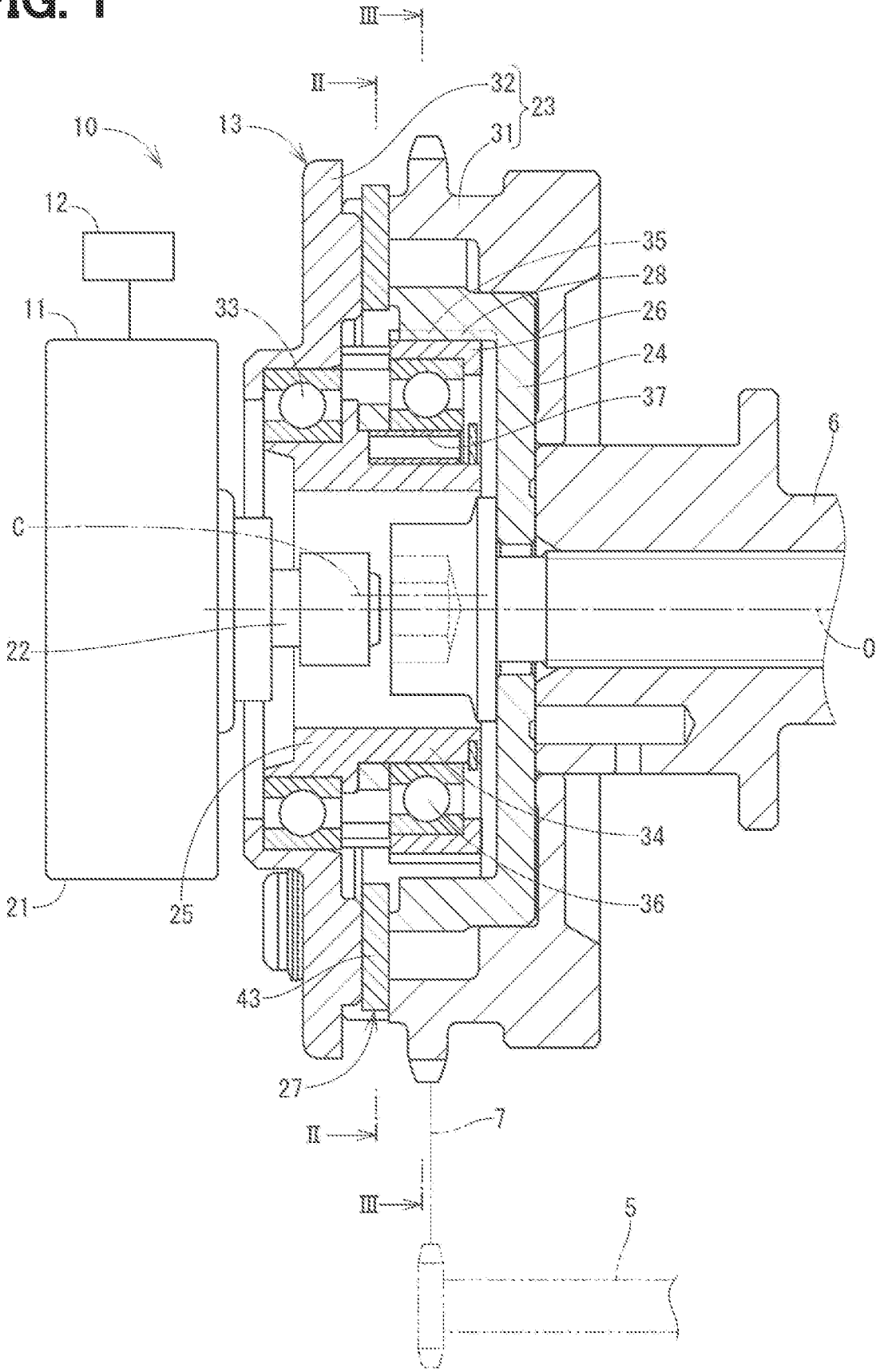
FIG. 1 is a diagram indicating a valve timing adjustment device of a first embodiment, showing a cross-section taken along line I-I in FIG. 2.
Figure 2:
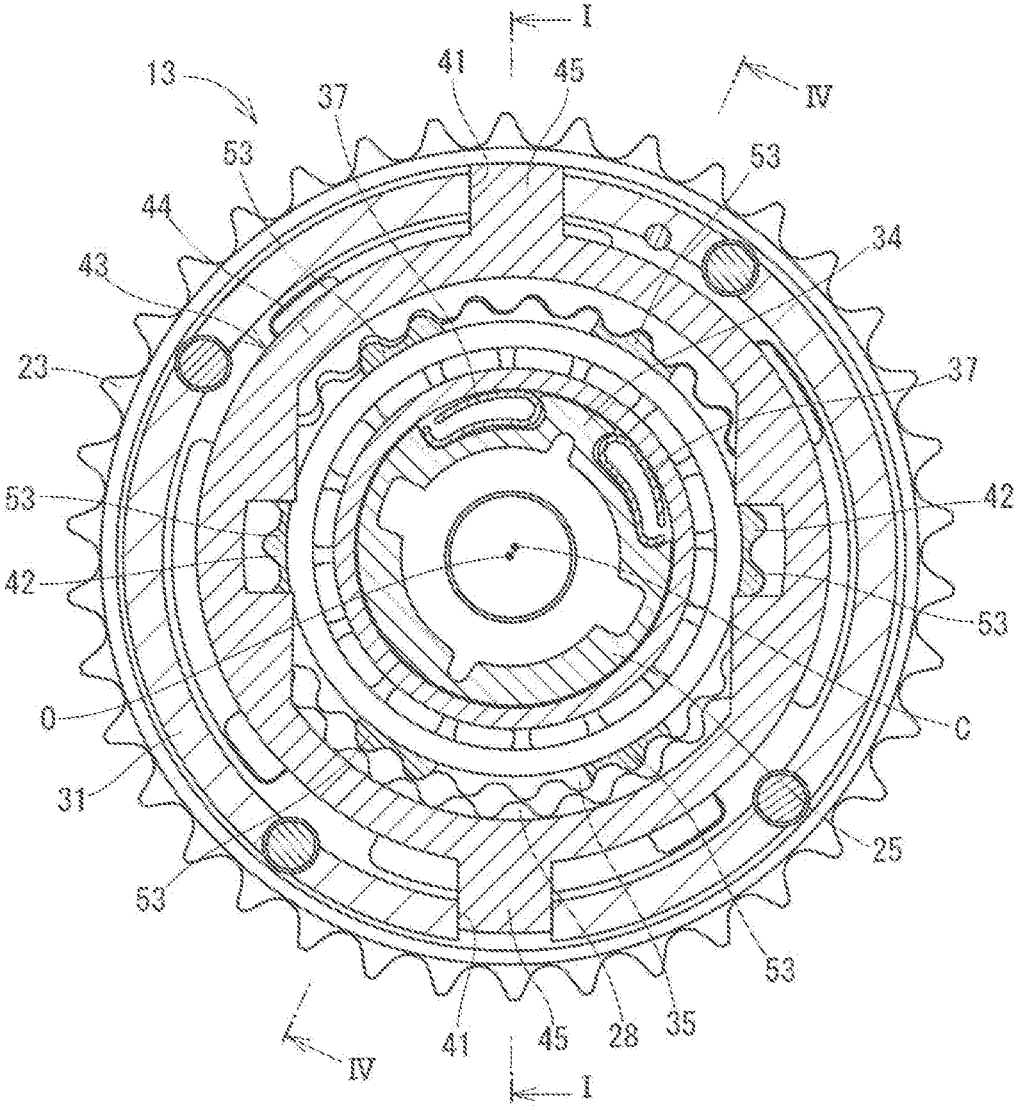
FIG. 2 is a cross-sectional view taken along line II-II in FIG. 1.
Figure 3:
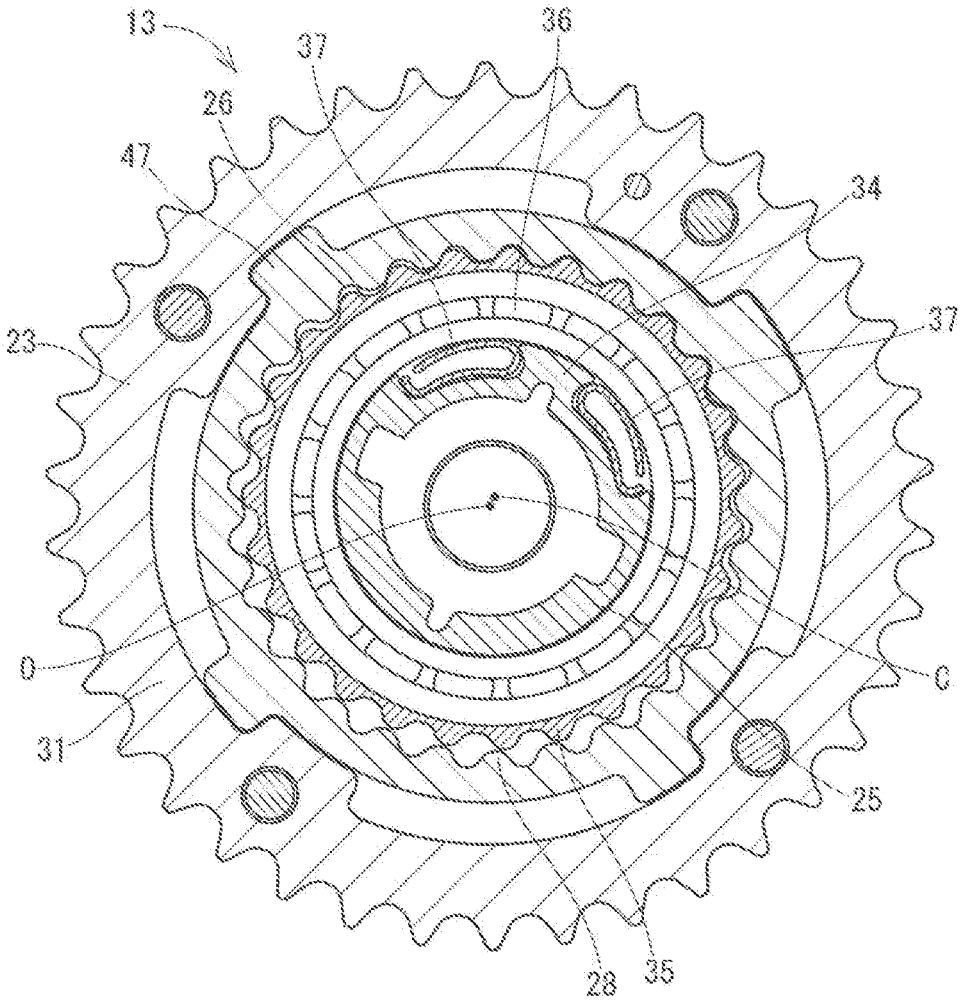
FIG. 3 is a cross-sectional view taken along line III-III in FIG. 1.

A previously proposed valve timing adjustment device includes a planetary gear mechanism which has an internal gear section and a planetary gear section. The valve timing adjustment device adjusts a rotational phase of a driven-side rotatable body relative to a driving-side rotatable body. The planetary gear section is urged against the internal gear section by a resilient member to reduce a noise and an impact force generated when the planetary gear section and the internal gear section collide with each other due to, for example, a change in a cam torque.

However, deteriorations in quietness and durability of the valve timing adjustment device are also caused by a collision between the components in the thrust direction in the valve timing adjustment device.

According to the present disclosure, there is provided a valve timing adjustment device configured to be installed to an internal combustion engine and adjust a valve timing of a valve that is opened and closed by a camshaft with a torque transmitted from a crankshaft. The valve timing adjustment device includes a driving-side rotatable body, a driven-side rotatable body, an internal gear section, a planetary rotatable body, an eccentric shaft, and a transmission mechanism. The driving-side rotatable body is configured to be rotated synchronously with the crankshaft about a rotational axis that is coaxial with the camshaft. The driven-side rotatable body is configured to be rotated integrally with the camshaft about the rotational axis. The internal gear section is formed at one of the driven-side rotatable body and the driving-side rotatable body. The planetary rotatable body has a planetary gear section. The planetary gear section is eccentric to the rotational axis and is meshed with the internal gear section. The eccentric shaft supports the planetary rotatable body. The transmission mechanism is configured to transmit rotation between the planetary rotatable body and another one of the driven-side rotatable body and the driving-side rotatable body.

A bearing portion of the planetary rotatable body for providing bearing support in a thrust direction is defined as a planetary thrust bearing portion. The driving-side rotatable body or the driven-side rotatable body, which is configured to contact the planetary thrust bearing portion in the thrust direction, is defined as a specific rotatable body. A bearing portion of the specific rotatable body for providing bearing support in the thrust direction is defined as a specific thrust bearing portion. In a parallel state where the specific thrust bearing portion and the planetary thrust bearing portion are parallel to each other, the specific thrust bearing portion and the planetary thrust bearing portion contact with each other only on one of an eccentric side and a counter-eccentric side of the planetary rotatable body while the counter-eccentric side is opposite to the eccentric side.

As described above, the specific thrust bearing portion and the planetary thrust bearing portion contact with each other on the one of the eccentric side and the counter-eccentric side and are spaced from each other on the other one of the eccentric side and the counter-eccentric side. In this way, a higher degree of freedom of tilting and a higher degree of positioning precision of the planetary rotatable body can be achieved. When the planetary rotatable body is tilted, a projected size of the planetary rotor in the axial direction is increased, and a clearance in the thrust direction between the planetary rotatable body and the specific rotatable body sides is reduced. In addition, the planetary rotatable body and the driving-side rotatable body contact with each other while changing the tilt angle of the planetary rotatable body relative to the driving-side rotatable body, so that the impact force is reduced. Therefore, the noise and the impact force, which are caused by the collision between the planetary rotatable body and the specific rotatable body, can be reduced, and thereby it is possible to achieve the improved quietness and the improved durability.

Hereinafter, embodiments of a valve timing adjustment device will be described with reference to the drawings. The same reference sign is used for substantially identical constituent elements among the embodiments, and description of the same will be omitted for the sake of simplicity. In addition, not only the combination of the configurations explicitly mentioned in the description of each embodiment, but also partial combinations of the constituent elements of respective embodiments can be made even if such a combination is not explicitly mentioned as long as there is no particular obstacle to the combination.

First Embodiment

As shown in FIG. 1, a valve timing adjustment device 10 according to a first embodiment is installed to a torque transmission path that extends from a crankshaft 5 to a camshaft 6 at an internal combustion engine of a vehicle. The camshaft 6 opens and closes intake valves or exhaust valves (not shown) which serve as valves. The valve timing adjustment device 10 adjusts the valve timing of these valves.

The valve timing adjustment device 10 includes an actuator 11, a control unit 12 and a phase shift unit 13.

The actuator 11 is an electric motor such as a brushless motor. The actuator 11 includes a housing 21 and a control shaft 22. The housing 21 rotatably supports the control shaft 22. The control unit 12 includes, for example, a motor driver, a microcomputer, and the like, and rotationally drives the control shaft 22 by controlling energization of the actuator 11.

As shown in FIGS. 1 to 4, the phase shift unit 13 includes a driving-side rotatable body 23, a driven-side rotatable body 24, an eccentric shaft 25, a planetary rotatable body 26, and a transmission mechanism 27.

The driving-side rotatable body 23 is coaxial with the camshaft 6 and includes a sprocket member 31, which is shaped in a bottomed tubular form, and a cover member 32, which is shaped in a stepped tubular form and is joined to the sprocket member 31. The driving-side rotatable body 23 receives the other constituent members 24, 25, 26, 27. The sprocket member 31 is coupled to the crankshaft 5 through a transmission member 7 such as a chain. Therefore, the driving-side rotatable body 23 is rotated about a rotational axis O, which is coaxial with the camshaft 6, synchronously with the crankshaft 5.

The driven-side rotatable body 24 is shaped in a bottomed tubular form and is fixed to an end part of the camshaft 6 through a bottom of the driven-side rotatable body 24. The driven-side rotatable body 24 is coaxial with the camshaft 6 and rotatably supports the sprocket member 31 from a radially inner side of the sprocket member 31. Therefore, the driven-side rotatable body 24 is rotated integrally with the camshaft 6 about the rotational axis O and is rotatable relative to the driving-side rotatable body 23.

The internal gear section 28 is integrally formed in one piece with the driven-side rotatable body 24 at an inner periphery of a tubular portion of the driven-side rotatable body 24. The internal gear section 28 is a gear section which is configured such that an addendum circle of the gear section is located on a radially inner side of a dedendum circle of the gear section.

The eccentric shaft 25 is shaped in a tubular form and is coaxial with the camshaft 6. The eccentric shaft 25 is supported by a radial bearing 33, which is installed at an inside of the cover member 32 such that the eccentric shaft 25 is rotatable about the rotational axis O. An eccentric portion 34, which is eccentric to the rotational axis O, is formed at a portion of the eccentric shaft 25 an extent of which overlaps with an extent the internal gear section 28 in the axial direction.

The planetary rotatable body 26 includes a planetary gear section 35 which is eccentric to the rotational axis O and is meshed with the internal gear section 28. The planetary gear section 35 is a gear section that is configured such that an addendum circle of the gear section is located on a radially outer side of a dedendum circle of the gear section. The planetary rotatable body 26 is supported by a radial bearing 36 installed at an outside of the eccentric portion 34 such that the planetary rotatable body 26 is rotatable about a spin axis C. The planetary gear section 35 integrally makes a planetary motion while changing a meshing location, at which the planetary gear section 35 and the internal gear section 28 are meshed with each other, in response to the rotation of the eccentric shaft 25 relative to the driving-side rotatable body 23. At this time, the planetary rotatable body 26 revolves around the rotational axis O while rotating around the spin axis C under the state where the planetary rotatable body 26 is meshed with the driven-side rotatable body 24 on an eccentric side.

A plurality of resilient members 37 are placed between the radial bearing 36 and the eccentric side part of the eccentric portion 34. The resilient members 37 urge the planetary rotatable body 26 toward the eccentric side in the radial direction through the radial bearing 36. Therefore, the planetary gear section 35 maintains a meshed state where the planetary gear section 35 and the internal gear section 28 are meshed with each other.

The transmission mechanism 27 transmits rotation between the driving-side rotatable body 23 and the planetary rotatable body 26 while absorbing the eccentricity between the driving-side rotatable body 23 and the planetary rotatable body 26. Specifically, the transmission mechanism 27 is an Oldham mechanism that includes: a plurality of primary engaging grooves 41 formed at the sprocket member 31; a plurality of secondary engaging projections 42 formed at the planetary rotatable body 26; and a slider 43 that transmits rotation between the primary engaging grooves 41 and the secondary engaging projections 42 while swinging in the radial direction relative to the primary engaging grooves 41 and the secondary engaging projections 42. The slider 43 includes: a ring 44; a plurality of primary engaging projections 45 which radially outwardly project from the ring 44 and respectively fitted to the primary engaging grooves 41; and a plurality of secondary engaging grooves 46 which are formed at an inner periphery of the ring 44 and are respectively fitted to the secondary engaging projections 42.

The valve timing adjustment device 10, which has the above-described configuration, adjusts a rotational phase (hereinafter simply referred to as "rotational phase") of the driven-side rotatable body 24 relative to the driving-side rotatable body 23 within a predetermined phase adjustment range according to a rotational state of the control shaft 22. As a result, the valve timing adjustment, which is suitable for the operational state of the internal combustion engine, can be realized.

Specifically, in a state where the control shaft 22 is rotated at the same speed as that of the driving-side rotatable body 23, and thereby the eccentric shaft 25 does not rotate relative to the driving-side rotatable body 23, the planetary rotatable body 26 does not have a planetary motion. As a result, the rotatable bodies 23, 24 rotate integrally with the planetary rotatable body 26 so that the rotational phase does not substantially change, and thereby the current valve timing is maintained.

In contrast, when the control shaft 22 is rotated at a lower speed relative to the rotational speed of the driving-side rotatable body 23 or is rotated in the opposite direction relative to the rotational direction of the driving-side rotatable body 23, the eccentric shaft 25 is rotated relative to the driving-side rotatable body 23 in a retarding direction. At this time, the planetary rotatable body 26 makes the planetary motion. Thus, the driven-side rotatable body 24 is rotated in the retarding direction relative to the driving-side rotatable body 23 to retard the rotational phase so that the valve timing is retarded.

In contrast, when the control shaft 22 is rotated at a higher speed relative to the rotational speed of the driving-side rotatable body 23, the eccentric shaft 25 is rotated relative to the driving-side rotatable body 23 in an advancing direction. At this time, the planetary rotatable body 26 makes the planetary motion. Thus, the driven-side rotatable body 24 is rotated in the advancing direction relative to the driving-side rotatable body 23 to advance the rotational phase so that the valve timing is advanced.

The phase adjustment range, within which the rotational phase is adjusted, is limited when stoppers 47 of the driven-side rotatable body 24 are engaged to and are stopped by the driving-side rotatable body 23 at one side or the other side in the rotational direction.

Next, a bearing structure of the planetary rotatable body 26 for providing bearing support in a thrust direction will be described.

As in the case of the valve timing adjustment device 10, when the direction of the torque inputted to the planetary gear mechanism is periodically switched, the impact noise and collision wear caused by a collision between components become an issue. This type of collision occurs not only on the torque-transmitting surfaces of gears and the Oldham mechanism, but also on the thrust bearing sites (i.e., the axial limiting sites). The valve timing adjustment device 10 has a configuration for limiting the collision in the thrust direction of the planetary rotatable body 26.

As shown in FIGS. 2 to 5, the planetary rotatable body 26 includes a planetary thrust bearing portion 51 which serves as a bearing portion for providing thrust support in the thrust direction. The driving-side rotatable body 23, which serves as a specific rotatable body that contacts the planetary thrust bearing portion 51 in the thrust direction, includes a specific thrust bearing portion 52 that is a bearing portion for providing bearing support in the thrust direction. The planetary thrust bearing portion 51 and the specific thrust bearing portion 52 form a thrust bearing between the planetary rotatable body 26 and the driving-side rotatable body 23.

The planetary thrust bearing portion 51 is formed by distal end portions of a plurality of projections 53 which project toward the driving-side rotatable body 23 in the axial direction. In the first embodiment, the number of the projections 53 is six, and these projections 53 are arranged at equal intervals along a circle that is concentric with the spin axis C. Two of the six projections 53 serve as the primary engaging projections 45.

Figure 4:
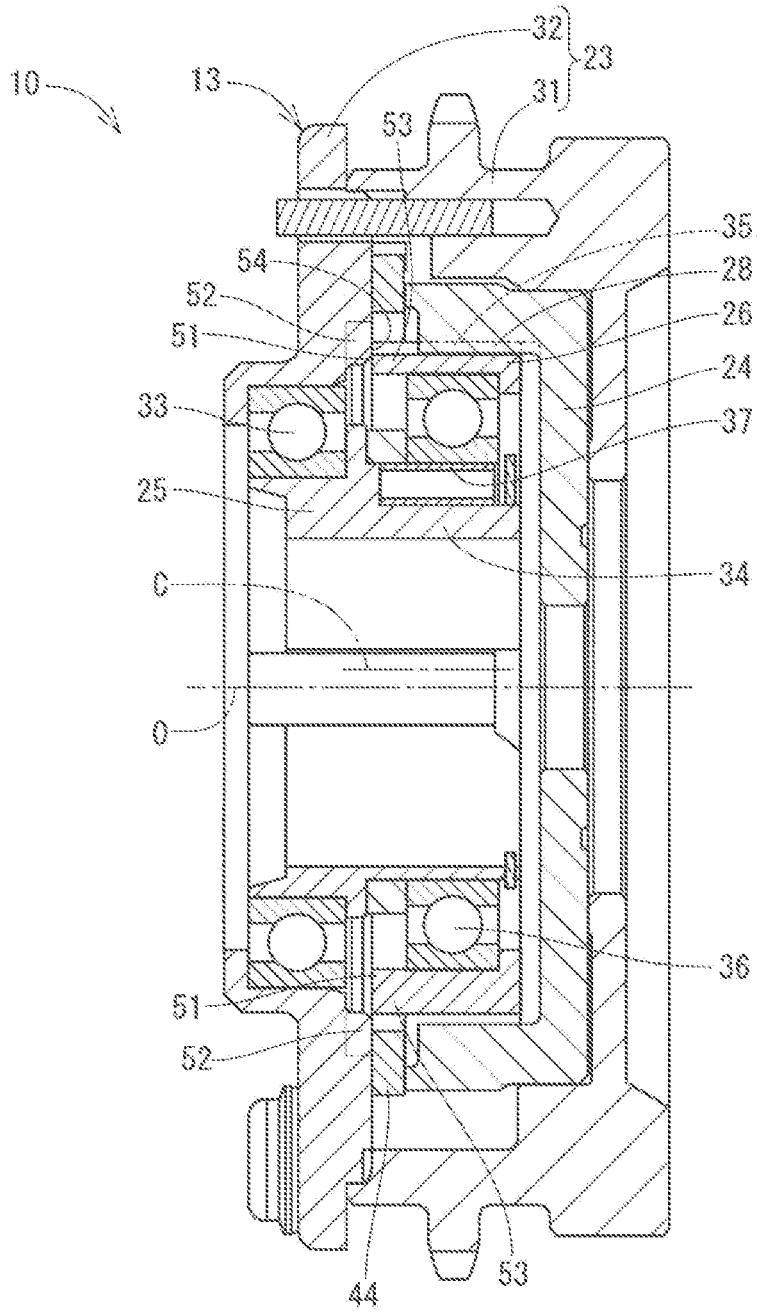
FIG. 4 is a cross-sectional view taken along line IV-IV in FIG. 2.
Figure 5:
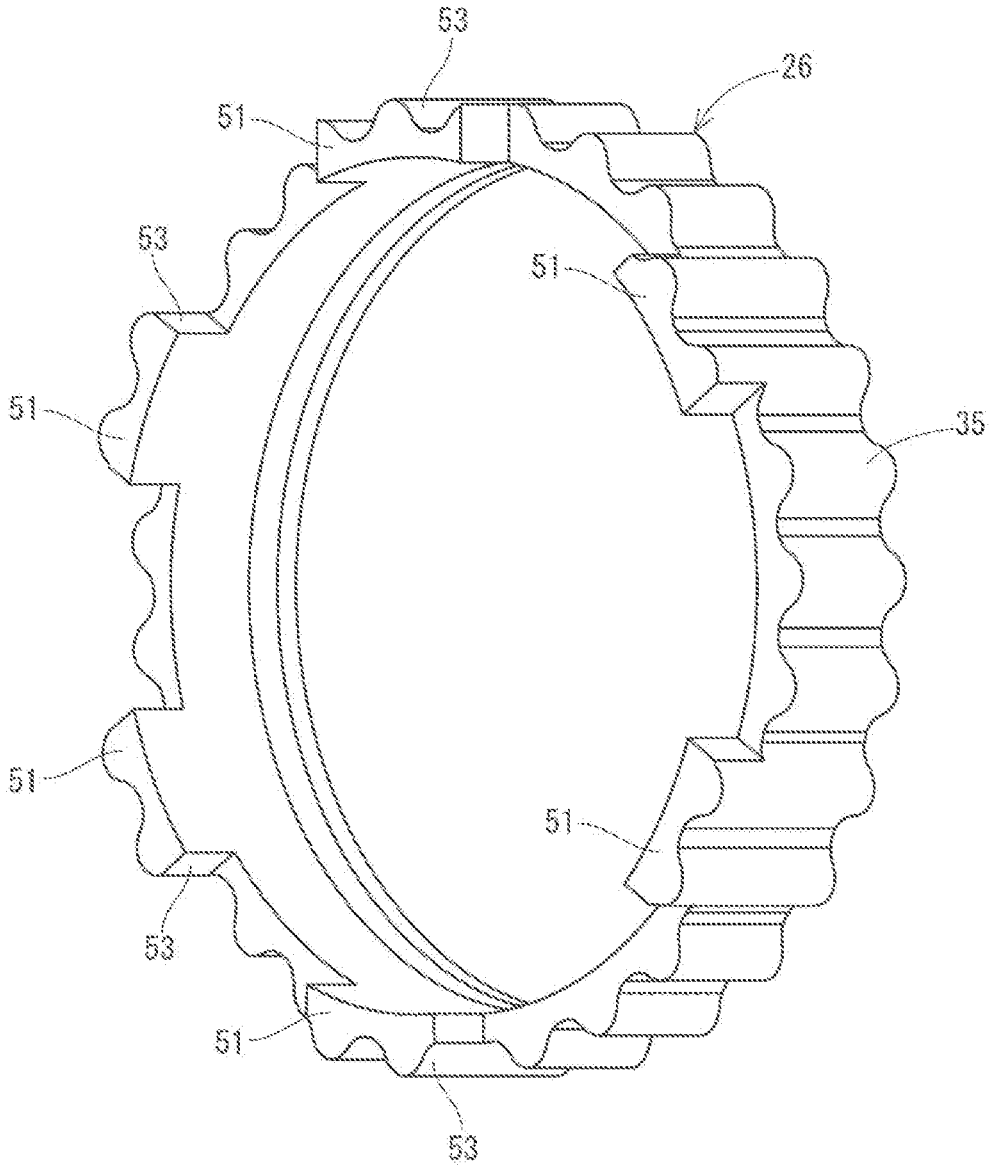
FIG. 5 is a perspective view of a planetary rotatable body of FIG. 1.
Figure 6:
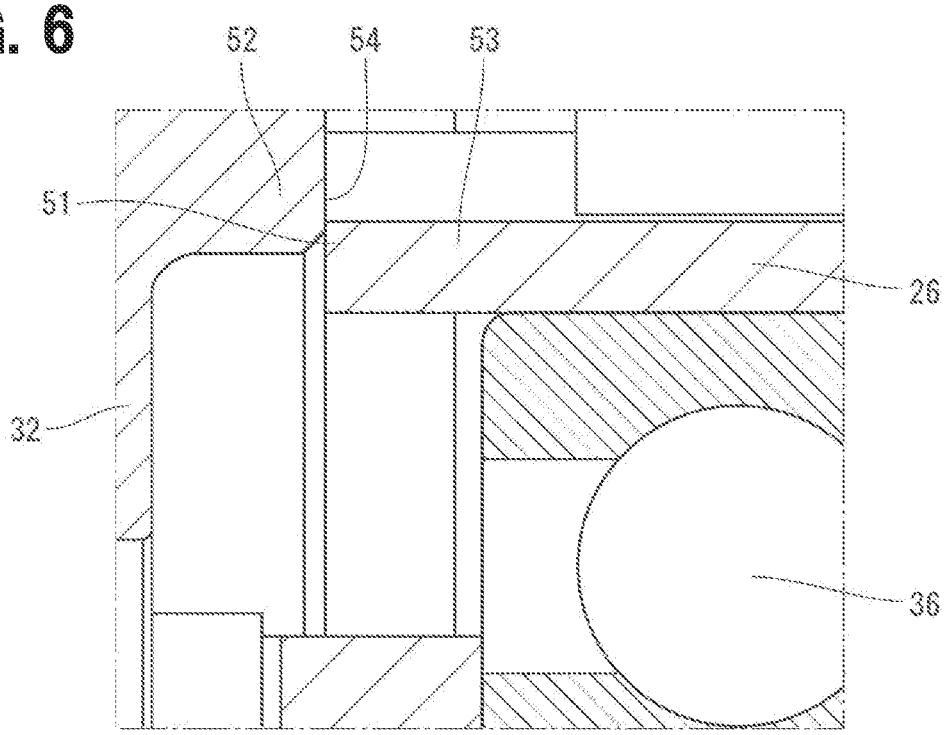
FIG. 6 is an enlarged view of an upper portion of FIG. 4.
Figure 7:
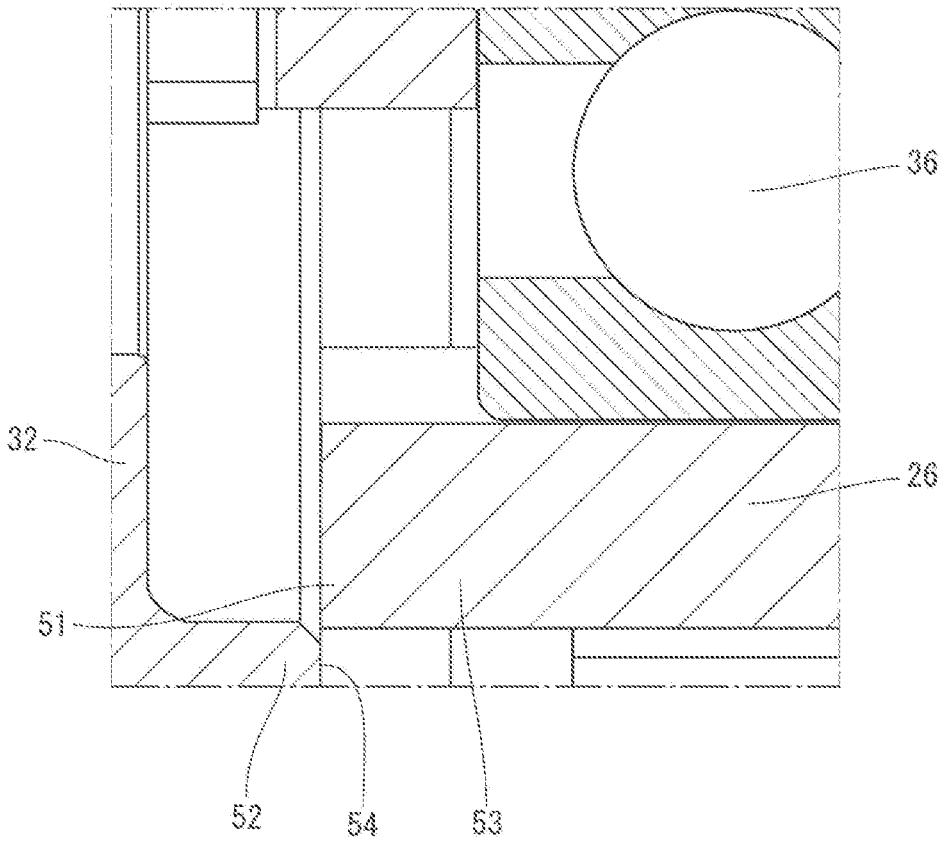
FIG. 7 is an enlarged view of a lower portion of FIG. 4.

As shown in FIGS. 4, 6 and 7, the specific thrust bearing portion 52 is an inner periphery of an end portion of the driving-side rotatable body 23 located on the planetary rotatable body 26 side and is formed by a circular ring portion that is coaxial with the rotational axis O. The specific thrust bearing portion 52 includes a specific receiving surface 54 that is in a form of a circular ring and is configured to contact the planetary thrust bearing portion 51. In FIGS. 4 and 7, each which shows a cross section that extends along the rotational axis O and is parallel with an eccentric direction, the specific receiving surface 54 is spaced from the planetary thrust bearing portion 51 toward the radially outer side. Specifically, a relief space exists on the radially inner side of the specific receiving surface 54 to relieve a counter-eccentric side part of the planetary thrust bearing portion 51 into the relief space when the planetary rotatable body 26 is tilted such that the eccentric side of the planetary thrust bearing portion 51 contacts the specific receiving surface 54 while the counter-eccentric side part of the planetary thrust bearing portion 51, which is opposite to the eccentric side part of the planetary thrust bearing portion 51 in the radial direction, approaches the driving-side rotatable body 23. Therefore, in a parallel state where the specific thrust bearing portion 52 and the planetary thrust bearing portion 51 are parallel to each other, the specific thrust bearing portion 52 and the planetary thrust bearing portion 51 contact with each other only on the eccentric side of the planetary rotatable body 26.

Advantages

As described above, according to the first embodiment, in the parallel state where the specific thrust bearing portion 52 and the planetary thrust bearing portion 51 are parallel to each other, the specific thrust bearing portion 52 and the planetary thrust bearing portion 51 contact with each other only on the eccentric side of the planetary rotatable body 26. As described above, the specific thrust bearing portion 52 and the planetary thrust bearing portion 51 contact with each other on the eccentric side and are spaced from each other on the counter-eccentric side, so that a higher degree of freedom of tilting and a higher degree of positioning precision of the planetary rotatable body 26 can be achieved. When the planetary rotatable body 26 is tilted, a projected size of the planetary rotatable body 26 in the axial direction is increased, and a clearance in the thrust direction between the planetary rotatable body 26 and the driving-side rotatable body 23 is reduced. In addition, at the time of collision, the planetary rotatable body 26 and the driving-side rotatable body 23 contact with each other while changing the tilt angle of the planetary rotatable body 26 relative to the driving-side rotatable body 23 so that the collision impact is reduced. Therefore, the noise and impact force, which are caused by the collision between the planetary rotatable body 26 and the driving-side rotatable body 23 in the thrust direction, can be reduced, and thereby it is possible to achieve the improved quietness and the improved durability.

In addition, at least a portion of the planetary rotatable body 26 can maintain a small clearance in the thrust direction between the portion of the planetary rotatable body 26 and the driving-side rotatable body 23, so that it is possible to limit vigorous movement (e.g., rattling) of the planetary rotatable body 26 in the axial direction.

In the most of cases, the force, which tilts the planetary rotatable body 26, is a radial component force generated by the torque transmitted at the meshed part between the planetary gear section 35 and the internal gear section 28. Therefore, the tilting direction of the planetary rotatable body 26 becomes a direction perpendicular to the eccentric direction. In the first embodiment, the specific thrust bearing portion 52 and the planetary thrust bearing portion 51 are configured to contact with each other on the eccentric side and are spaced from each other on the counter-eccentric side, so that a tiltable range of the planetary rotatable body 26 is increased, and the valve timing adjustment device implements the improved quietness.

In addition, unlike a case where the clearance in the thrust direction is reduced by urging the planetary rotatable body in the axial direction with a resilient member or the like, the noise and the impact force can be reduced without requiring an additional component in the first embodiment.

Second Embodiment

Figure 8:
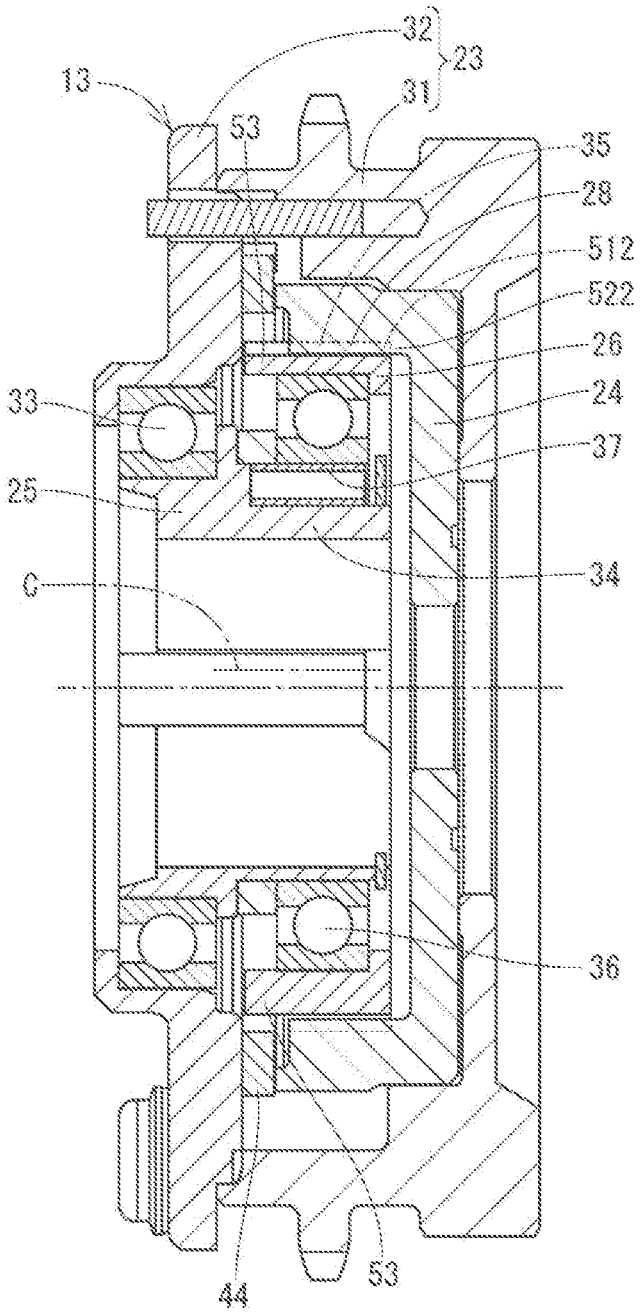
FIG. 8 is a cross-sectional view of a valve timing adjustment device of a second embodiment, corresponding to FIG. 4.

In a second embodiment, as shown in FIG. 8, the planetary thrust bearing portion 512 is formed by an end portion of the planetary rotatable body 26 which is located on the driven-side rotatable body 24 side of the planetary rotatable body 26. The specific thrust bearing portion 522 is formed by a circular ring portion of the driven-side rotatable body 24 which is placed to oppose the planetary thrust bearing portion 512 in the axial direction and is coaxial with the rotational axis O. Therefore, in a parallel state where the specific thrust bearing portion 522 and the planetary thrust bearing portion 512 are parallel to each other, the specific thrust bearing portion 522 and the planetary thrust bearing portion 512 contact with each other only on the eccentric side of the planetary rotatable body 26.

The thrust bearing may be provided between the planetary rotatable body 26 and the driven-side rotatable body 24 in the above-described manner. Even with this configuration, the specific thrust bearing portion 522 and the planetary thrust bearing portion 512 contact with each other on the eccentric side and are spaced from each other on the counter-eccentric side, so that the advantages, which are similar to those of the first embodiment, can be achieved.

Third Embodiment

Figure 9:
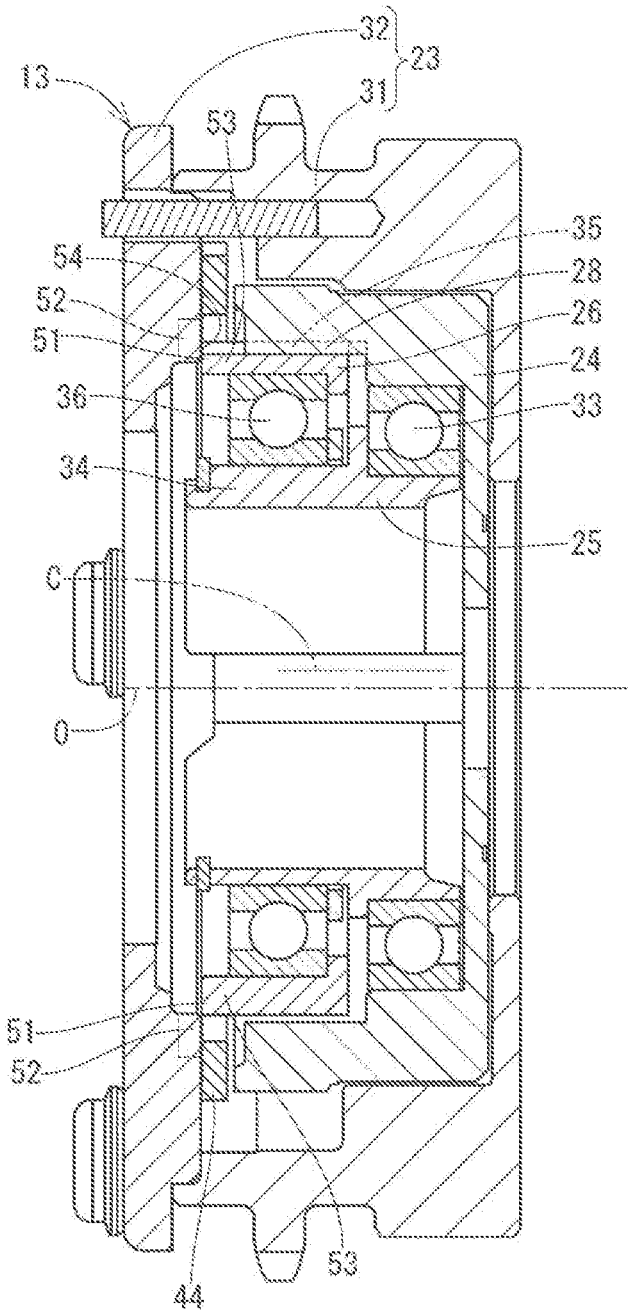
FIG. 9 is a cross-sectional view of a valve timing adjustment device of a third embodiment, corresponding to FIG. 4.

In a third embodiment, as shown in FIG. 9, the radial bearing 33 is placed on the inner side of the tubular portion of the driven-side rotatable body 24. When the radial bearing 33 is placed on the opposite side of the planetary rotatable body 26, which is opposite to the specific thrust bearing portion 52, the eccentric shaft 25 is more likely to tilt. Thereby, when the planetary rotatable body 26 is tilted, the clearance in the thrust direction is reduced. Thus, the noise and the impact force can be effectively reduced.

Fourth Embodiment

Figure 10:
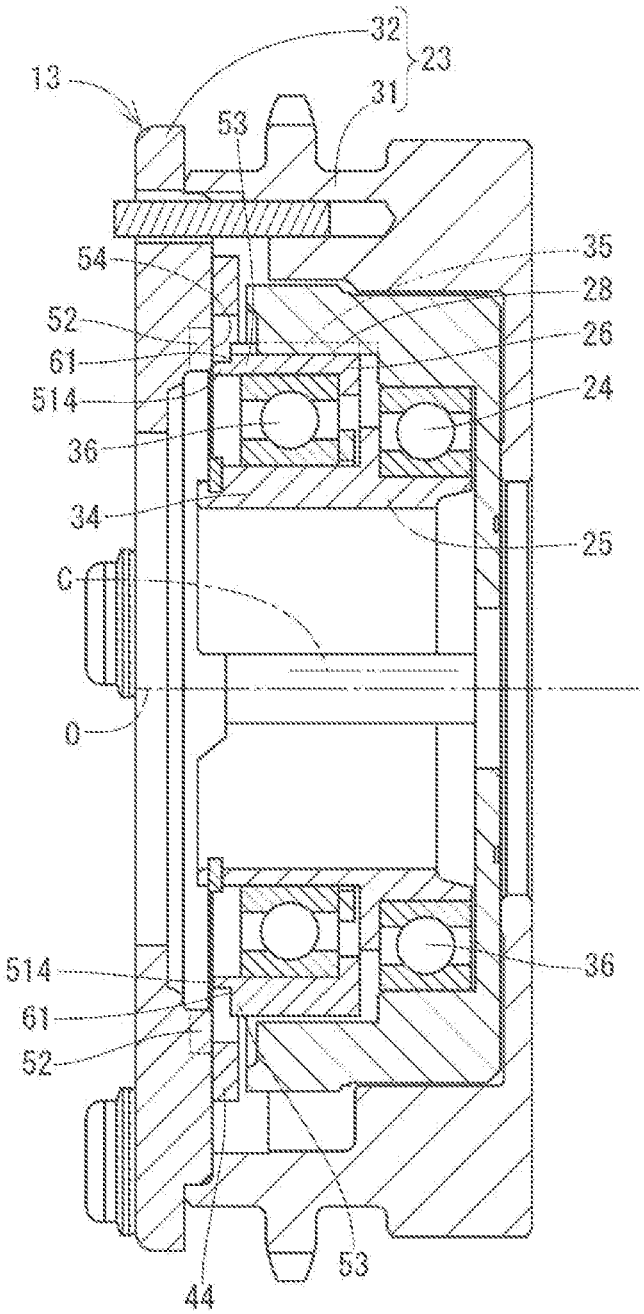
FIG. 10 is a cross-sectional view of a valve timing adjustment device of a fourth embodiment, corresponding to FIG. 4.
Figure 11:
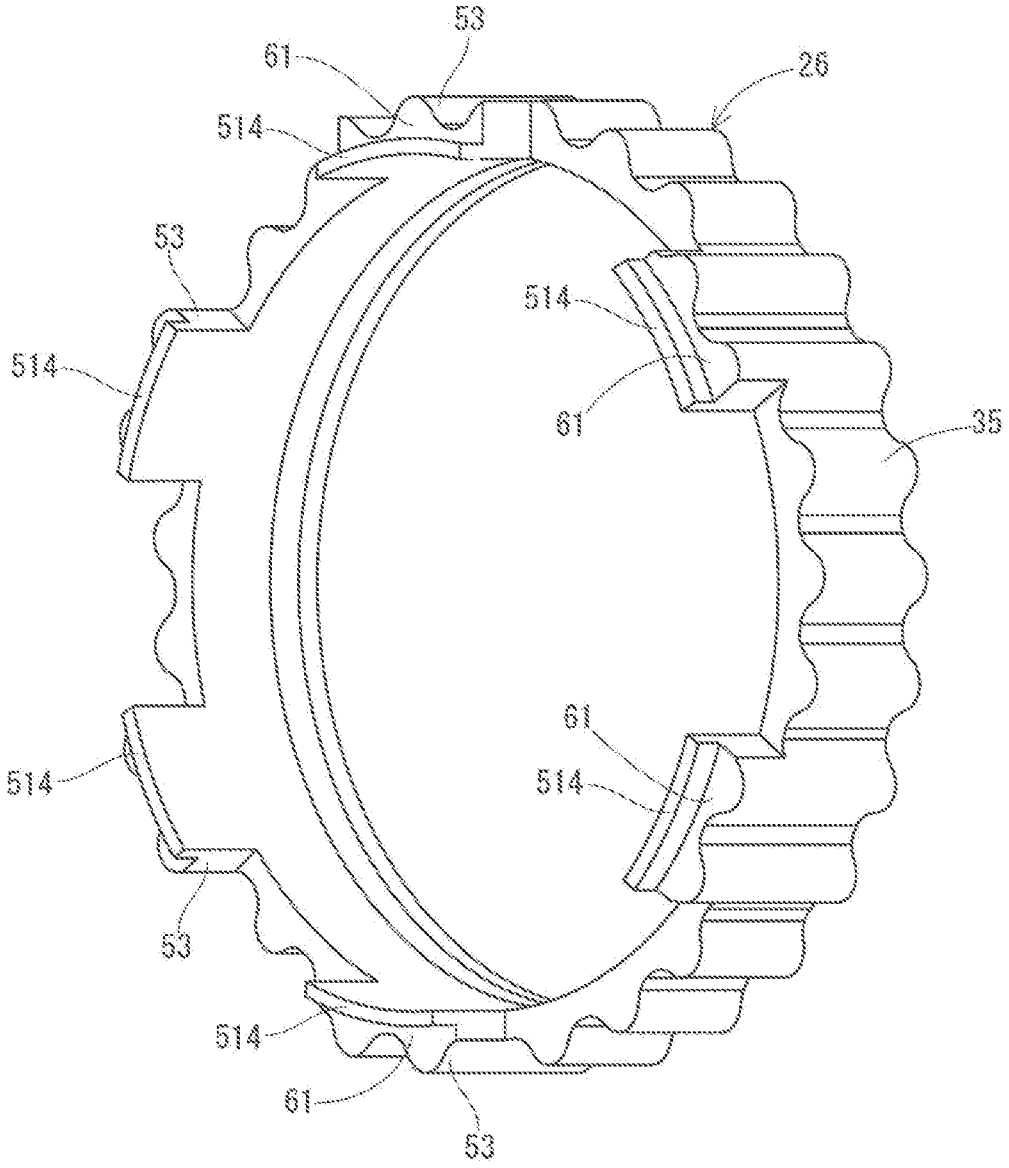
FIG. 11 is a perspective view of a planetary rotatable body of FIG. 10.
Figure 12:
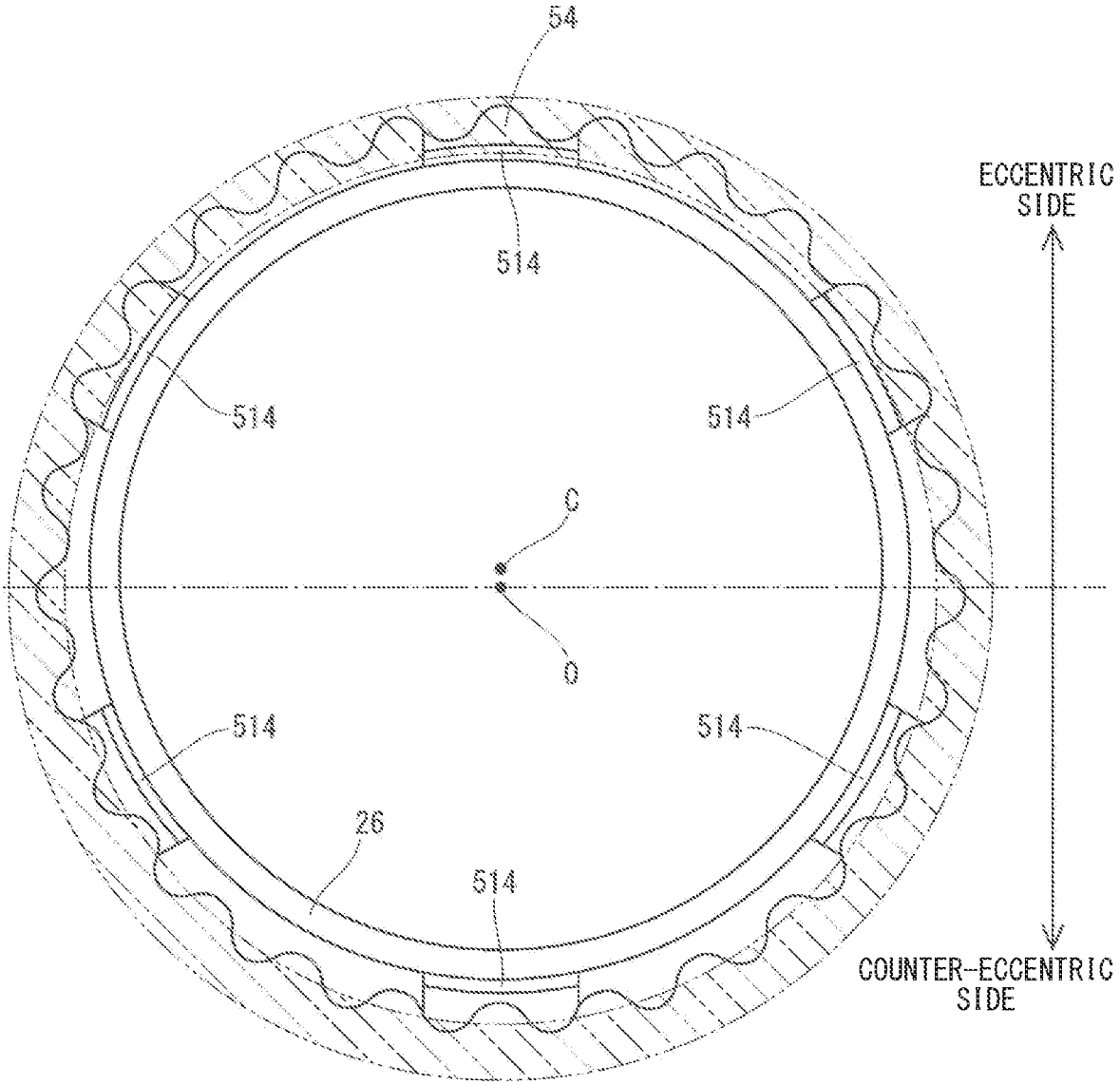
FIG. 12 is a diagram indicating a planetary rotatable body and a specific receiving surface of FIG. 10 seen from a specific receiving surface side.

In a fourth embodiment, as shown in FIGS. 10 and 11, the outer diameter of the planetary thrust bearing portion 514 is reduced in comparison to the outer diameter of the planetary thrust bearing portion 51 of the first embodiment. Specifically, a recess 61 is formed at each of the projections 53 at a location which is on the radially outer side of the planetary thrust bearing portion 514, and the recess 61 is recessed in a direction opposite to the specific thrust bearing portion 52. The outer diameter B of the planetary thrust bearing portion 514 is smaller than the inner diameter A of the specific thrust bearing portion 52. Therefore, as shown in FIG. 12, the counter-eccentric side of the specific receiving surface 54 is spaced away from the planetary thrust bearing portion 514 in the radial direction, so that the counter-eccentric side half of the specific receiving surface 54 will not contact the planetary thrust bearing portion 514.

With the above configuration, the specific thrust bearing portion 52 and the planetary thrust bearing portion 51 can be reliably spaced from each other on the counter-eccentric side, so that the planetary rotatable body 26 is more likely to be tilted, and thereby the noise and the impact force can be effectively reduced.

Fifth Embodiment

Figure 13:
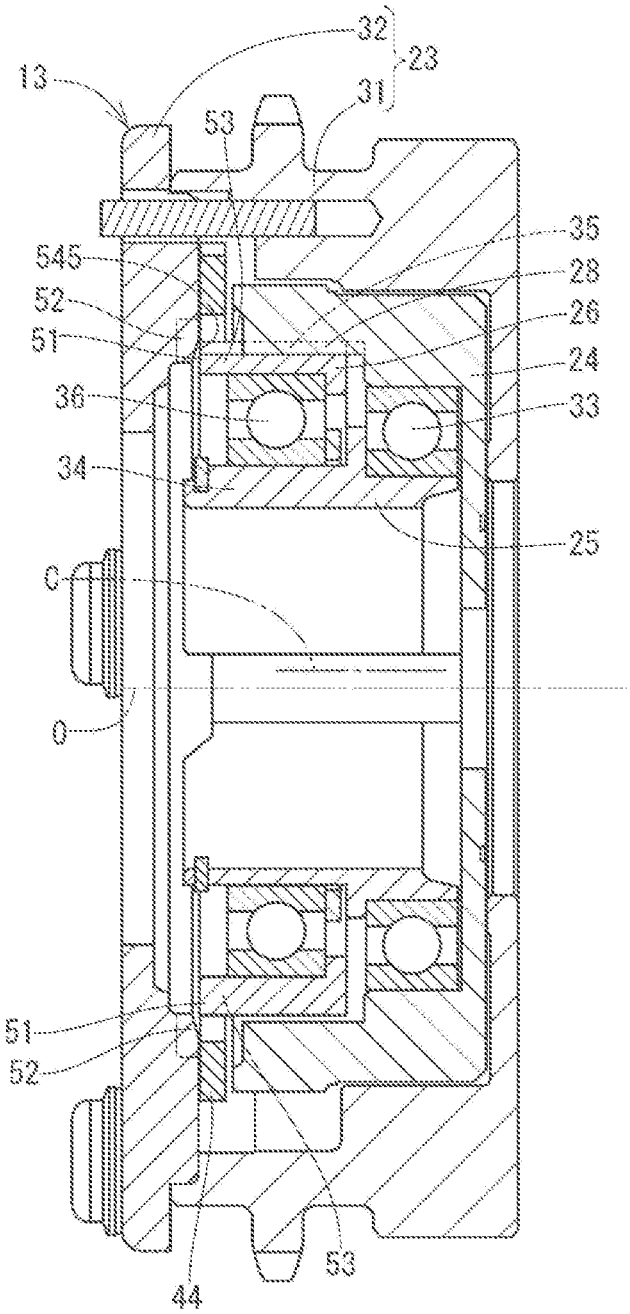
FIG. 13 is a cross-sectional view of a valve timing adjustment device of a fifth embodiment, corresponding to FIG. 4.

In a fifth embodiment, as shown in FIG. 13, the specific thrust bearing portion 52 has a specific receiving surface 545 that is a tapered surface formed at an inner periphery of the specific thrust bearing portion 52 such that the specific receiving surface 545 is progressively spaced away from the planetary thrust bearing portion 51 in an inner radial direction. With the above configuration, the specific thrust bearing portion 52 and the planetary thrust bearing portion 51 can be reliably spaced from each other on the counter-eccentric side, so that the planetary rotatable body 26 is more likely to be tilted, and thereby the noise and the impact force can be effectively reduced.

Sixth Embodiment

Figure 14:
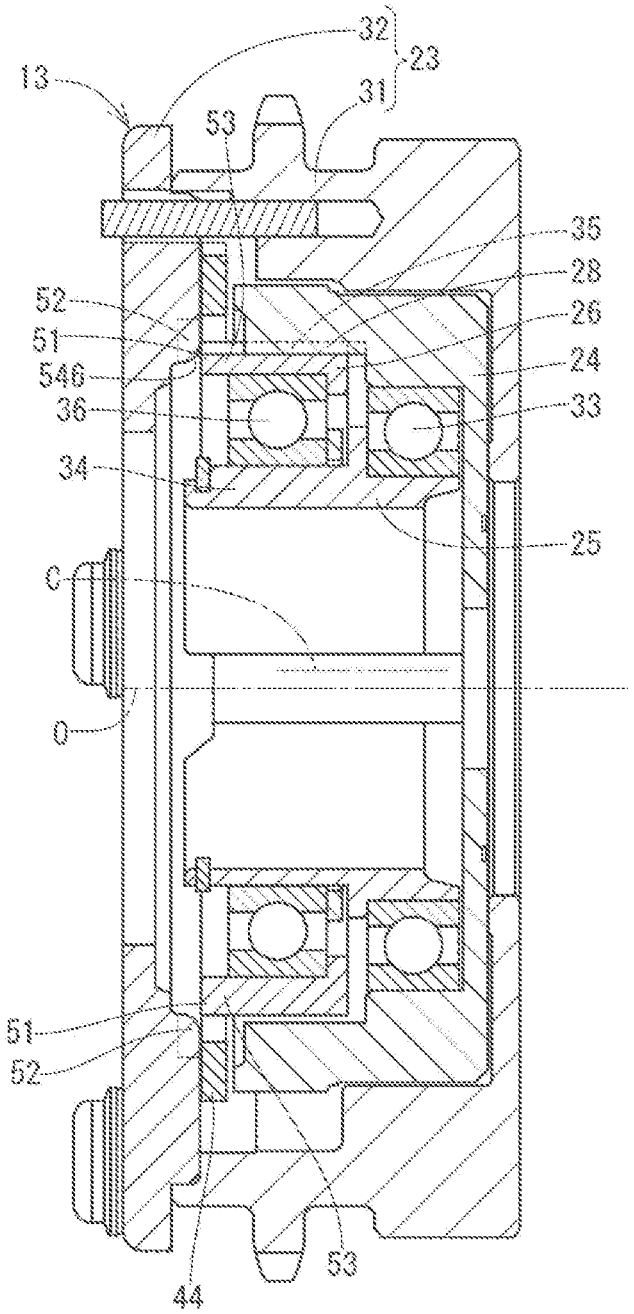
FIG. 14 is a cross-sectional view of a valve timing adjustment device of a sixth embodiment, corresponding to FIG. 4.

In a sixth embodiment, as shown in FIG. 14, the specific thrust bearing portion 52 has a specific receiving surface 546 that is a curved surface formed at an inner periphery of the specific thrust bearing portion 52 such that the specific receiving surface 546 is progressively spaced away from the planetary thrust bearing portion 51 in the inner radial direction. With the above configuration, the specific thrust bearing portion 52 and the planetary thrust bearing portion 51 can be reliably spaced from each other on the counter-eccentric side, so that the planetary rotatable body 26 is more likely to be tilted, and thereby the noise and the impact force can be effectively reduced.

Seventh Embodiment

Figure 15:
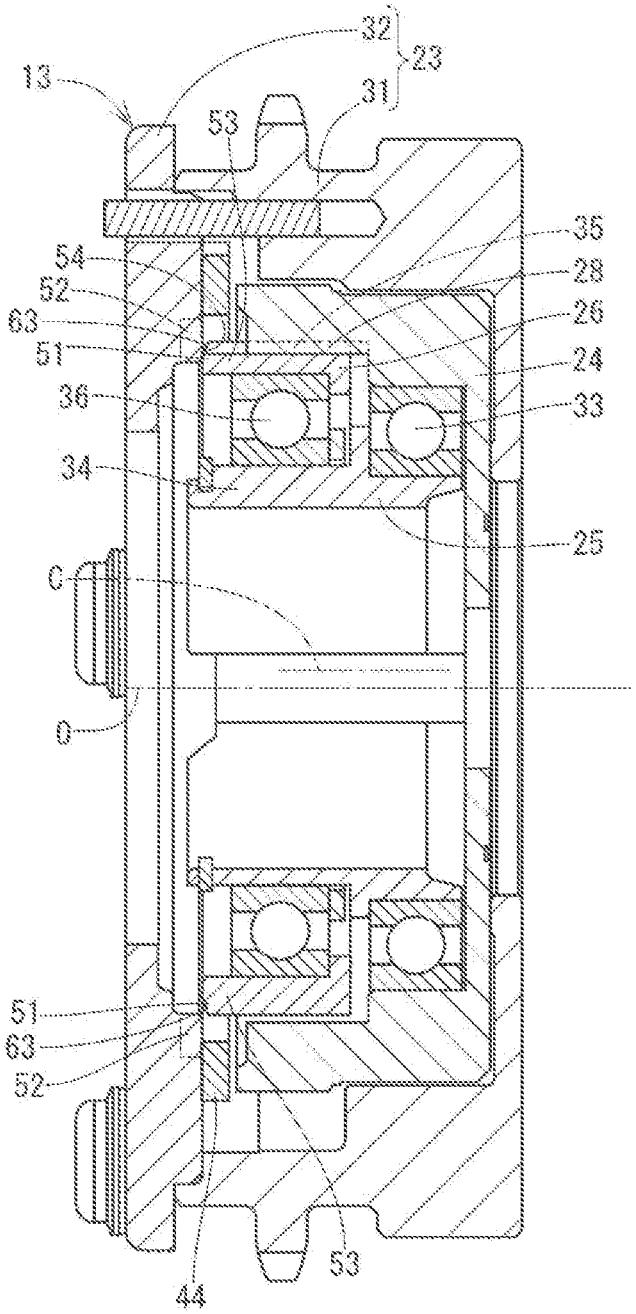
FIG. 15 is a cross-sectional view of a valve timing adjustment device of a seventh embodiment, corresponding to FIG. 4.

In a seventh embodiment, as shown in FIG. 15, the planetary thrust bearing portion 51 has a tapered surface 63 that is formed at an outer periphery of the planetary thrust bearing portion 51 such that the tapered surface 63 is progressively spaced away from the specific thrust bearing portion 52 in an outer radial direction. With the above configuration, the specific thrust bearing portion 52 and the planetary thrust bearing portion 51 can be reliably spaced from each other on the counter-eccentric side, so that the planetary rotatable body 26 is more likely to be tilted, and thereby the noise and the impact force can be effectively reduced.

Eighth Embodiment

Figure 16:
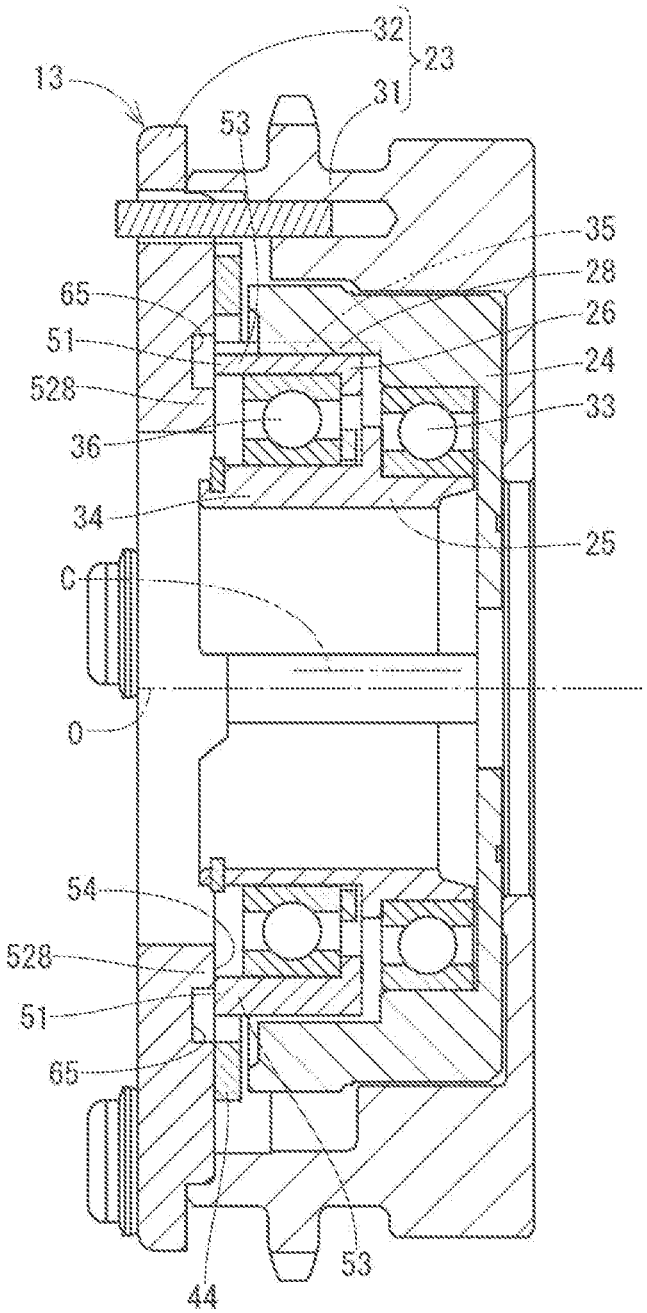
FIG. 16 is a cross-sectional view of a valve timing adjustment device of an eighth embodiment, corresponding to FIG. 4.

In an eighth embodiment, as shown in FIG. 16, the specific thrust bearing portion 528 is formed by a ring portion that is coaxial with the rotational axis O, and the specific thrust bearing portion 528 has a recess 65 that is formed such that an outer periphery of the specific thrust bearing portion 528 is recessed in a direction opposite to the planetary rotatable body 26 relative to an inner periphery of the specific thrust bearing portion 528. In the parallel state where the specific thrust bearing portion 528 and the planetary thrust bearing portion 51 are parallel to each other, the specific thrust bearing portion 528 contacts the planetary thrust bearing portion 51 only on the counter-eccentric side.

As described above, the specific thrust bearing portion 528 and the planetary thrust bearing portion 51 may contact with each other on the counter-eccentric side and may be spaced from each other on the eccentric side. Even with this configuration, when the planetary rotatable body 26 is tilted, the clearance in the thrust direction is reduced. Thus, the advantages, which are similar to those of the first embodiment, can be achieved.

Ninth Embodiment

Figure 17:
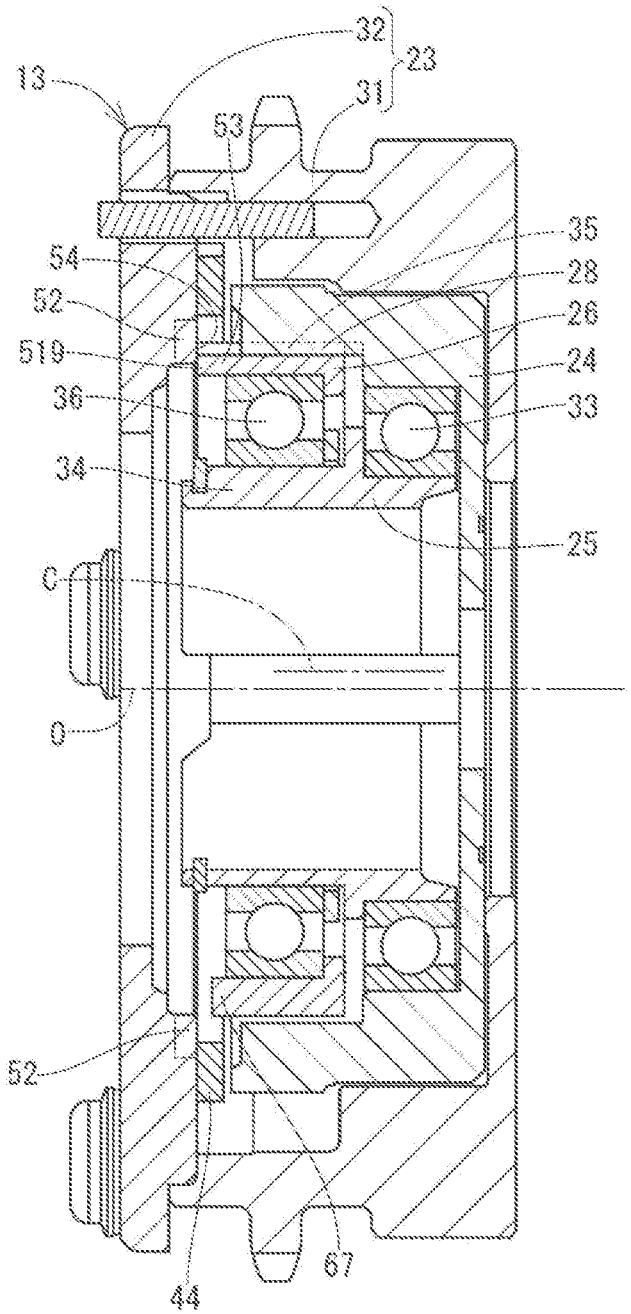
FIG. 17 is a cross-sectional view of a valve timing adjustment device of a ninth embodiment, corresponding to FIG. 4.
Figure 18:
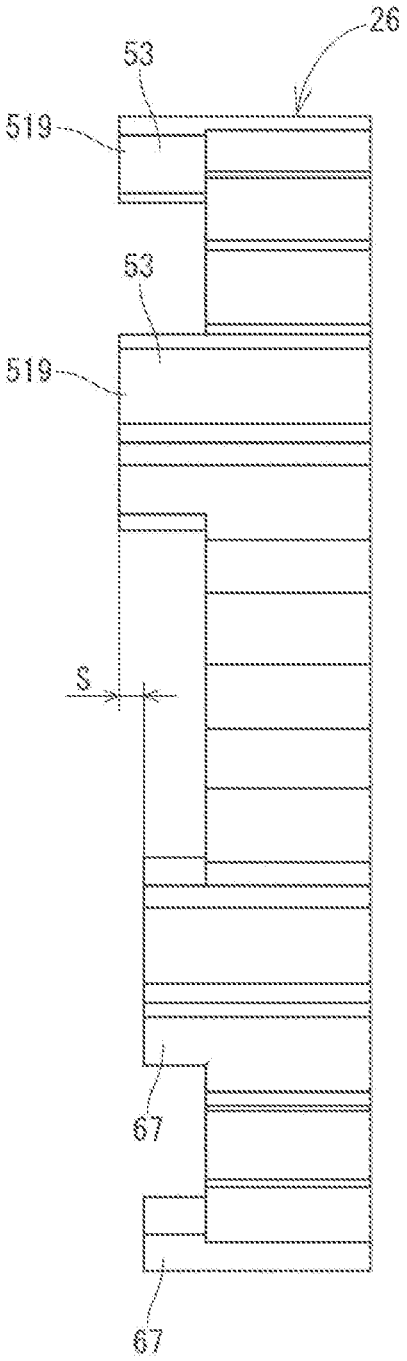
FIG. 18 is a side view of a planetary rotatable body of FIG. 17.

In a ninth embodiment, as shown in FIGS. 17 and 18, the planetary thrust bearing portion 519 is formed by distal end portions of the projections 53 which are placed on the eccentric side when the rotational phase is a specific phase. A plurality of projections 67, which are placed on the counter-eccentric side when the rotational phase is the specific phase, have an axial length that is shorter than that of the projections 53, which are placed on the eccentric side. Specifically, an axial step (axial gap) is formed between the projections 67 and the projections 53. With the above configuration, the specific thrust bearing portion 52 and the planetary thrust bearing portion 519 contact with each other only on the eccentric side when the rotational phase is the specific phase.

The specific phase is a rotational phase during the idling rotation of the engine in which the noise is particularly prominent. Thus, when the planetary rotatable body 26 is tilted to reduce the clearance in the thrust direction during the idling rotation of the engine in which the noise is particularly prominent, the noise and the impact force can be reduced.

Furthermore, in the ninth embodiment, the control unit 12 controls the operation of the valve timing adjustment device such that the rotational phase is not kept at the specific phase when the engine rotational speed is a high rotational speed range which is equal to or higher than 3000 rpm. As a result, it is possible to limit the planetary gear section 35 from being excessively tilted at the high rotational speed of the engine and promoting wear.

Tenth Embodiment

Figure 19:
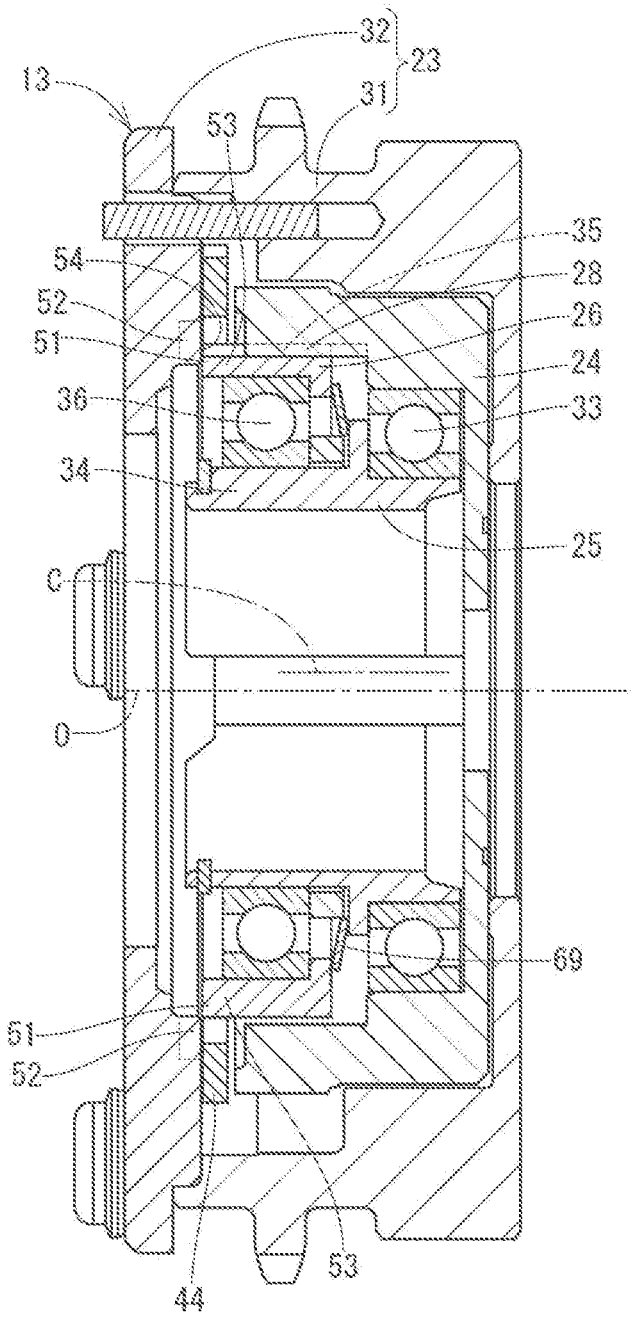
FIG. 19 is a cross-sectional view of a valve timing adjustment device of a tenth embodiment, corresponding to FIG. 4.

In a tenth embodiment, as shown in FIG. 19, there is provided an urging portion 69 that urges the planetary rotatable body 26 toward the specific thrust bearing portion 52. In the tenth embodiment, the urging portion 69 is a disc spring. However, the urging portion 69 may be formed by an elastic body or an oil pressure generating means. When the pressure is pre-applied in the thrust direction in this way, the clearance is further reduced. Thus, the noise and the impact force can be further effectively reduced.

Eleventh Embodiment

Figure 20:
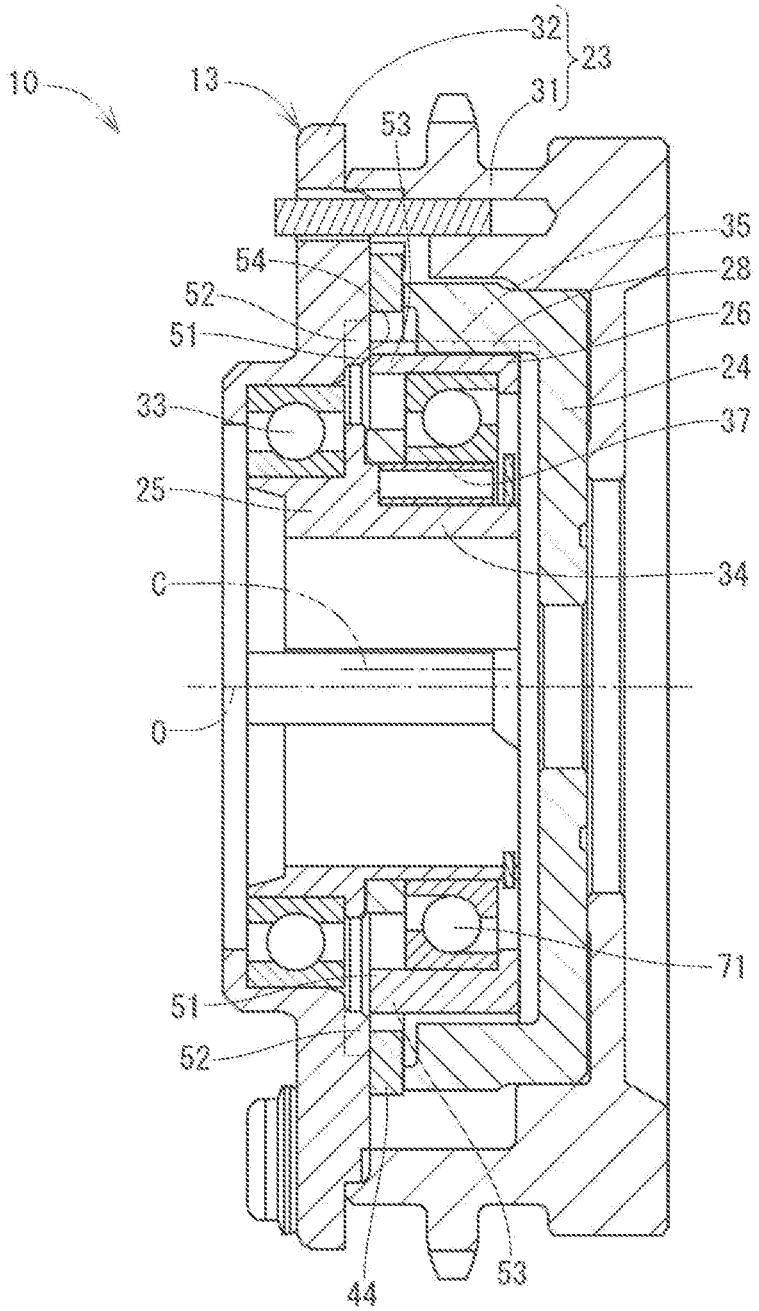
FIG. 20 is a cross-sectional view of a valve timing adjustment device of an eleventh embodiment, corresponding to FIG. 4.

In an eleventh embodiment, as shown in FIG. 20, a radial bearing 71 placed between the eccentric portion 34 and the planetary rotatable body 26 is an angular contact ball bearing. An axial component of a force, which is exerted at the radial bearing 71 by the resilient members (serving as urging portions) 37, urges the planetary rotatable body 26 toward the specific thrust bearing portion 52. When the pressure is pre-applied in the thrust direction in this way, the clearance is further reduced. Thus, the noise and the impact force can be further effectively reduced.

Other Embodiments

In the ninth embodiment, the planetary thrust bearing portion 519 is provided at the part of the planetary rotatable body 26 partially located in the rotational direction, so that the specific thrust bearing portion 52 and the planetary thrust bearing portion 519 contact with each other only at the eccentric side only at the specific phase. Alternatively, in another embodiment, a recess may be provided at a part of the specific thrust bearing portion partially located in the rotational direction, so that the specific thrust bearing portion and the planetary thrust bearing portion contact with each other only at the eccentric side at the specific phase.

In another embodiment, the internal gear section may be formed at the driving-side rotatable body. Furthermore, the transmission mechanism may be configured to transmit the rotation between the driven-side rotatable body and the planetary rotatable body.

The present disclosure has been described with reference to the embodiments. However, the present disclosure should not be limited to the embodiments and the configurations described therein. The present disclosure also includes various variations and variations within an equivalent range.

Furthermore, other combinations and other forms including various combinations and various forms of only one element, or more, or less, are also within the scope and spirit of the present disclosure.

What is claimed is:

1. A valve timing adjustment device configured to be installed to an internal combustion engine and adjust a valve timing of a valve that is opened and closed by a camshaft with a torque transmitted from a crankshaft, the valve timing adjustment device comprising:

a driving-side rotatable body that is configured to be rotated synchronously with the crankshaft about a rotational axis that is coaxial with the camshaft;

a driven-side rotatable body that is configured to be rotated integrally with the camshaft about the rotational axis;

an internal gear section that is formed at one of the driven-side rotatable body and the driving-side rotatable body;

a planetary rotatable body that has a planetary gear section, wherein the planetary gear section is eccentric to the rotational axis and is meshed with the internal gear section;

an eccentric shaft that supports the planetary rotatable body; and a transmission mechanism that is configured to transmit rotation between the planetary rotatable body and another one of the driven-side rotatable body and the driving-side rotatable body, wherein:

a bearing portion of the planetary rotatable body for providing bearing support in a thrust direction is defined as a planetary thrust bearing portion;

the driving-side rotatable body or the driven-side rotatable body, which is configured to contact the planetary thrust bearing portion in the thrust direction, is defined as a specific rotatable body;

a bearing portion of the specific rotatable body for providing bearing support in the thrust direction is defined as a specific thrust bearing portion; and in a parallel state where the specific thrust bearing portion and the planetary thrust bearing portion are parallel to each other, the specific thrust bearing portion and the planetary thrust bearing portion contact with each other only on one of an eccentric side and a counter-eccentric side of the planetary rotatable body while the counter-eccentric side is opposite to the eccentric side.

2. The valve timing adjustment device according to claim 1, wherein:

the planetary thrust bearing portion is located along a circle that is concentric to a spin axis of the planetary rotatable body; and the planetary rotatable body has a recess that is located on a radially outer side of the planetary thrust bearing portion and is recessed in a direction opposite to the specific rotatable body.

3. The valve timing adjustment device according to claim 1, wherein:

the specific thrust bearing portion is formed by a ring portion that is coaxial with the rotational axis; and the specific rotatable body has a recess that is located on a radially outer side or a radially inner side of the specific thrust bearing portion and is recessed in a direction opposite to the planetary rotatable body.

4. The valve timing adjustment device according to claim 1, wherein:

a surface of the specific thrust bearing portion, which is configured to contact the planetary thrust bearing portion, is defined as a specific receiving surface; and one side of the specific receiving surface, which is on the eccentric side or the counter-eccentric side in a radial direction, is spaced away from the planetary thrust bearing portion.

5. The valve timing adjustment device according to claim 1, wherein an outer diameter of the planetary thrust bearing portion is smaller than an inner diameter of the specific thrust bearing portion.

6. The valve timing adjustment device according to claim 1, wherein the specific thrust bearing portion has a tapered surface or a curved surface that is progressively spaced away from the planetary thrust bearing portion in an inner radial direction.

7. The valve timing adjustment device according to claim 1, wherein the planetary thrust bearing portion has a tapered surface or a curved surface that is progressively spaced away from the specific thrust bearing portion in an outer radial direction.

8. The valve timing adjustment device according to claim 1, wherein when a rotational phase between the driving-side rotatable body and the driven-side rotatable body is a specific phase, the specific thrust bearing portion and the planetary thrust bearing portion contact with each other only on the one of the eccentric side and the counter-eccentric side.

9. The valve timing adjustment device according to claim 1, further comprising an urging portion that urges the planetary rotatable body toward the specific thrust bearing portion.

10. The valve timing adjustment device according to claim 1, further comprising:

a radial bearing that is installed between the eccentric shaft and the planetary rotatable body; and an urging portion that is installed between the radial bearing and the eccentric shaft and is configured to radially urge the planetary rotatable body through the radial bearing, wherein:

an axial component of a force, which is exerted at the radial bearing by the urging portion, urges the planetary rotatable body toward the specific thrust bearing portion.

* * * * *